US009634426B2

(12) United States Patent
Nazzaro et al.

(10) Patent No.: US 9,634,426 B2
(45) Date of Patent: Apr. 25, 2017

(54) ELECTRONIC DEVICE WITH HIDDEN CONNECTOR

(71) Applicant: APPLE INC., Cuptertino, CA (US)

(72) Inventors: David I. Nazzaro, Saratoga, CA (US); Tyler S. Bushnell, Mountain View, CA (US); Ibuki Kamei, San Jose, CA (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 15/079,785

(22) Filed: Mar. 24, 2016

(65) Prior Publication Data

US 2016/0204537 A1 Jul. 14, 2016

Related U.S. Application Data

(63) Continuation of application No. 14/299,921, filed on Jun. 9, 2014, now Pat. No. 9,331,422.

(51) Int. Cl.

| | |
|---|---|
| ***H01R 13/52*** | (2006.01) |
| ***H01R 13/44*** | (2006.01) |
| ***H01R 13/46*** | (2006.01) |
| ***H01R 13/453*** | (2006.01) |
| ***H01R 24/58*** | (2011.01) |

(52) U.S. Cl.

CPC ..... *H01R 13/5216* (2013.01); *H01R 13/44* (2013.01); *H01R 13/453* (2013.01); *H01R 13/46* (2013.01); *H01R 13/52* (2013.01); *H01R 24/58* (2013.01)

(58) Field of Classification Search

CPC ..... H01R 13/5216; H01R 43/005
USPC ..... 439/271, 519, 521, 520
See application file for complete search history.

(56) References Cited

U.S. PATENT DOCUMENTS

| | | | | |
|---|---|---|---|---|
| 7,534,146 | B2 * | 5/2009 | Chien | H01R 24/58 439/668 |
| 8,376,789 | B2 * | 2/2013 | Jol | H01R 13/187 439/668 |
| 2009/0069045 | A1 * | 3/2009 | Cheng | H02J 7/0042 455/556.1 |
| 2013/0052873 | A1 * | 2/2013 | Riezebos | H01R 13/35 439/620.21 |
| 2014/0082938 | A1 * | 3/2014 | King, Jr. | H01R 13/5208 29/863 |
| 2015/0157853 | A1 * | 6/2015 | Verzal | A61N 1/0551 600/25 |

OTHER PUBLICATIONS

Wang et al., "A Rapid and Efficient Self-Healing Thermo-Reversible Elastomer Crosslinked with Graphene Oxide", Aug. 15, 2013, http://onlinelibrary.wiley.com/wol1/doi/10.1002/adma.201302962/full.*

* cited by examiner

*Primary Examiner* — Amy Cohen Johnson
*Assistant Examiner* — Matthew T Dzierzynski
(74) *Attorney, Agent, or Firm* — Kilpatrick Townsend and Stockton, LLP

(57) ABSTRACT

An electronic device has a self-healing elastomer applied over one or more external electronic connectors. The self-healing elastomer may obscure the electronic connectors from the user as well as provide environmental protection for the connector and the electronic device. Electronic probes may temporarily penetrate the self-healing elastomer to mate with the electronic connector. After removal of the probes the self-healing elastomer may elastically reform and self-heal.

20 Claims, 9 Drawing Sheets

ELECTRONIC DEVICE WITH HIDDEN CONNECTOR

CROSS REFERENCE TO RELATED APPLICATIONS

This application claims priority to application Ser. No. 14/299,921, filed Jun. 9, 2014, titled "ELECTRONIC DEVICE WITH HIDDEN CONNECTOR", which is hereby incorporated by reference in its entirety for all purposes.

FIELD

The present invention relates generally to electronic devices and in particular to electronic devices that include one or more electrical connectors that enable connection to an external device.

BACKGROUND

A wide variety of electronic devices are available for consumers today that employ a broad range of external electronic connectors to facilitate communication with other devices and/or charging of the device.

As an example, audio jack and data connectors are sometimes positioned on one or more of the external surfaces of an electronic device and mounted to a printed circuit board (PCB) within the device. As smart-phones, media players, charging stations and other electronic devices are reduced in size, external connectors may consume a large proportion of the outside surface of the device, marring its aesthetic appeal. Additionally, as electronic devices become more indispensable to their operators, the devices are with their operators more frequently and are more likely to be exposed to harsh environments that may damage the connectors and the electronic device.

For example, miniature portable media players may be equipped with wireless communication and/or charging systems to increase their appeal to consumers. As wireless connections become more and more prevalent, an electrical connector on a device may be used less frequently. In some applications electronic devices may still require at least one external electrical connector for data exchange or charging when a wireless connection is not available and/or for diagnostic and repair purposes. In addition, the portable media player may frequently be with the consumer and exposed to rain and other harsh environments.

SUMMARY

Embodiments of the invention pertain to electrical connectors for use with a variety of electronic devices. In some embodiments, the electrical connectors are configured to be equipped with a self-healing barrier layer providing an aesthetic covering for the connector as well as protection for the contacts within the connector and for circuitry within the device housing.

One particular embodiment employs a connector having a plurality of contacts accessible through an opening in the housing of the electronic device. The connector is operatively coupled to electronic circuitry within the housing. A layer of self-healing elastomer covers the opening in the housing providing an aesthetic covering for the connector as well as environmental protection for the connector and the electronic device. In some embodiments the self-healing elastomer extends over the housing beyond the opening. In other embodiments the self-healing elastomer may be disposed only within the opening in the housing. One or more electrical probes may temporarily penetrate the self-healing elastomer to make contact with the connector contacts. After the electrical probes are removed, the self-healing elastomer may heal, regaining all, most or at least some of its aesthetic and protective properties.

Other embodiments may incorporate one or more conductively doped regions within the self-healing elastomer. The conductively doped regions may be disposed over each of the plurality of contacts of the connector. The electrical probes may then penetrate the self-healing elastomer and make contact with the conductively doped regions. The conductively doped regions may include conductive particulates such as, but not limited to, silver, gold, palladium, copper or metal coated spheres. In this embodiment, electrical current may pass through the electrical probe, through the conductively doped region to the connector contact.

In further embodiments an electronic connector with a plurality of contacts may be installed within the housing of an electronic device. The plurality of contacts may be accessible through an opening in the housing. The connector may have a cavity wherein the plurality of contacts are sequentially positioned within and spaced apart along the depth of the cavity. A layer of self-healing elastomer may be disposed over each of the plurality of contacts.

To better understand the nature and advantages of the present invention, reference should be made to the following description and the accompanying figures. It is to be understood, however, that each of the figures is provided for the purpose of illustration only and is not intended as a definition of the limits of the scope of the present invention. Also, as a general rule, and unless it is evident to the contrary from the description, where elements in different figures use identical reference numbers, the elements are generally either identical or at least similar in function or purpose.

DETAILED DESCRIPTION

Certain embodiments of the present invention relate to electronic devices. While the present invention can be useful for a wide variety of electronic devices, some embodiments of the invention are particularly useful for electronic devices that have a layer of self-healing elastomer disposed over one or more external electronic connectors, as described in more detail below.

Figure 1:
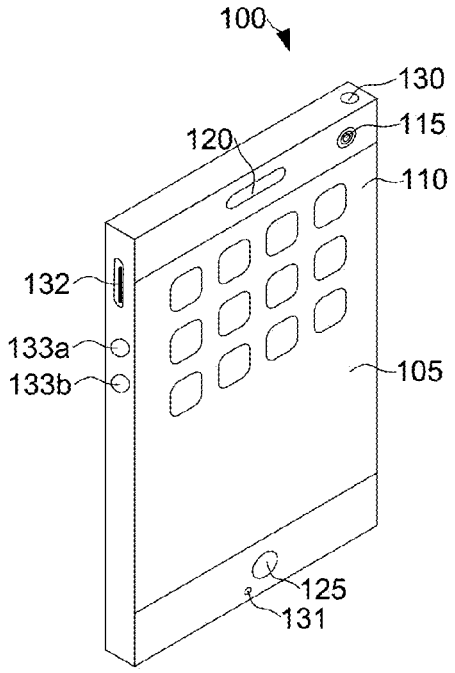
FIG. 1 is a front perspective view of an electronic device according to an embodiment of the invention.

FIG. 1 depicts a simplified diagram of an example electronic device 100 that may incorporate an embodiment. Device 100 is used for illustration only; the concepts/techniques of the invention can be employed in myriad electronic devices. For example, it is understood that embodiments of the invention are not limited to smartphones and may be employed in any type of electronic device including, but not limited to, wrist watches, portable media players, notebook computers, docking stations, desktop computers, portable radios, televisions, and set top boxes.

In the embodiment depicted in FIG. 1, electronic device 100 includes a front face 105 having a display screen 110, a sensor 115, a speaker 120, a home button 125, an audio connector 130 and a microphone 131. In some embodiments sensor 115 may be a camera, an infra-red detector or an ultrasonic detector. Although the embodiment in FIG. 1 shows only one display screen, sensor, speaker, home button, audio connector and microphone, it is understood that myriad configurations and quantities of these features are possible without departing from the invention. Electronic device 100 also includes on/off switch 132 and volume buttons 133*a*, 133*b*.

Figure 2:
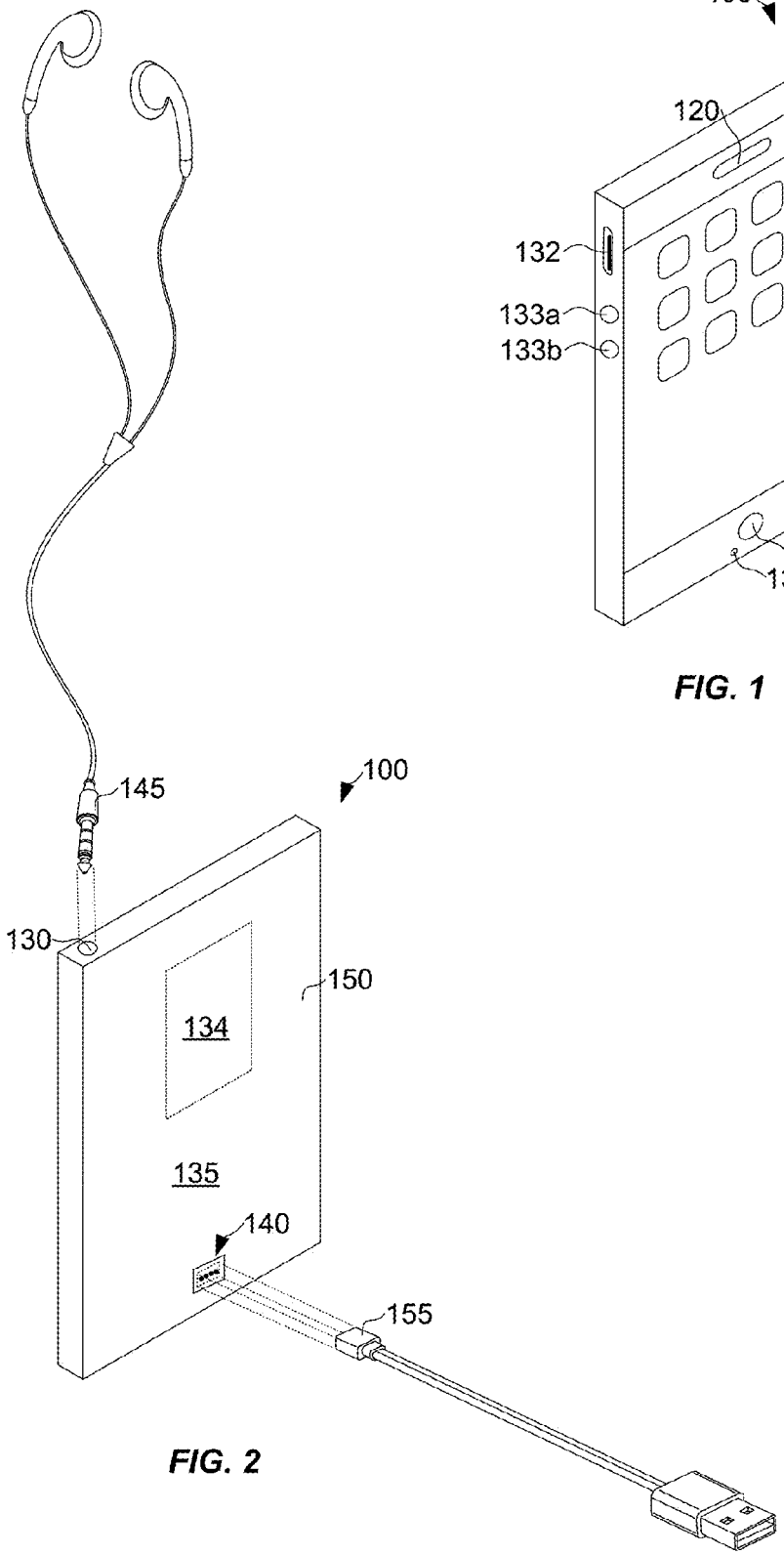
FIG. 2 is a rear perspective view of the electronic device shown in FIG. 1 with an audio connector and a data connector.

FIG. 2 depicts a simplified diagram of the rear of electronic device 100. Electronic device 100 includes housing 150 configured to be a rectangular prism having a back face 135 positioned opposite front face 105. In other embodiments, housing 150 may be shaped differently, for example in one embodiment the housing is curved and shaped to be worn on a user's wrist. Electronic circuitry 134 is disposed within housing 150 and is coupled to display screen 110, sensor 115, speaker 120, home button 125, audio connector 130, microphone 131, on/off switch 132 and volume buttons 133*a*, 133*b*. FIG. 2 also depicts an audio plug connector 145 that is matable with audio connector 130, and data plug connector 155 that is matable with data connector 140. In certain embodiments, one or more of connectors 130, 140 may employ an embodiment of the invention. Embodiments of the invention may be used on a variety of different electrical connectors.

Figure 3:
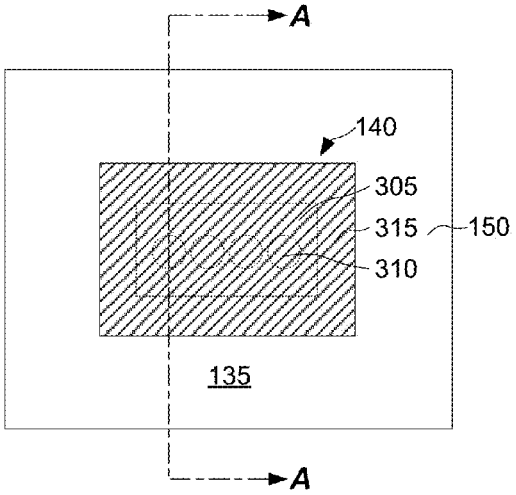
FIG. 3 is a plan view of the electrical connector shown in FIG. 1 covered by a self-healing elastomer and accessible through an opening in the device housing.
Figure 4:
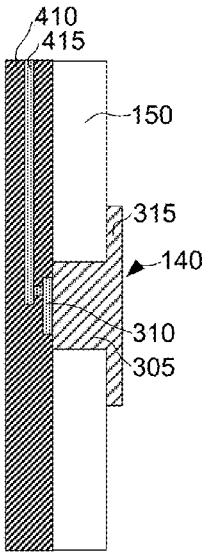
FIG. 4 is a cross-sectional view of the electrical connector shown in FIG. 3 before probe penetration.

FIG. 3 depicts a simplified close up plan view of data connector 140 and a portion of housing 150 (see FIG. 2), and FIG. 4 illustrates a simplified cross-section (see section A-A in FIG. 3) through one of plurality of contacts 310. Housing 150 has an opening 305. Data connector 140 is operatively coupled to electronic circuitry 134 (see FIG. 2) within housing 150. Data connector 140 includes plurality of contacts 310 disposed on a substrate 410 and accessible through opening 305. Although plurality contacts 310 are illustrated as four planar circular pads arranged in a linear pattern, the plurality of contacts may be of any number, any shape and any pattern. Further, in some embodiments, plurality of contacts 310 may not be pads, but may be other electrical contacts, such as, but not limited to blade-type connectors, sliding-type connectors or cylindrical-type pin and socket connectors. Substrate 410 may be a part of electronic circuitry 134 (see FIG. 2) disposed within housing 150.

Unlike in a typical electrical connector in which the contacts are exposed for an electrical connection to a corresponding connector, contacts 310 are buried beneath a layer of self-healing elastomer 315 which covers opening 305 and plurality of contacts 310. Elastomer 315 thus provides a strong environmental seal that protects contacts 310 from the environment including dust, debris, moisture and gas and prevents the contacts from being accessed without a tool or corresponding connector that can penetrate self-healing elastomer 315. In some embodiments, self-healing elastomer 315 may be filled with a pigment and blended with housing 150 such that it may appear contiguous with the housing and be substantially imperceptible thus hiding the connector such that a user may not even realize the electronic device even has an external connector.

In some embodiments self-healing elastomer 315 extends over housing 150, beyond opening 305. In other embodiments self-healing elastomer 315 may be disposed only within opening 305 and may not extend over housing 150. The size and thickness of self-healing elastomer 315 may depend on the size of opening 305, which in turn is dependent on the size and shape of connector 140 and the thickness of housing 150. In some embodiments where it is desirable for electronic device 100 to be thin, self-healing elastomer 315 may be less than 0.5 mm thick. In other embodiments self-healing elastomer 315 may be between 0.5 mm to 0.1 mm thick. In further embodiments self-healing elastomer 315 may be between 0.1 mm to 0.2 mm thick. In yet further embodiments self-healing elastomer 315 may be greater than 0.2 mm thick. In other embodiments the thickness of self-healing elastomer 315 may be greater than 0.5 mm.

Self-healing elastomer 315 may be a polymer with elastic properties such as a low Young's modulus and a high failure strain. In further embodiments, self-healing elastomer 315 may comprise a silicone material, also known as a polymerized siloxane. In some embodiments, the polymerized siloxane may be mixed inorganic-organic polymers with the chemical formula [R2SiO]n, where R is an organic group such as methyl, ethyl, or phenyl. In these embodiments the silicone material may comprise an inorganic silicon-oxygen backbone with organic side groups attached to the silicon atoms. In further embodiments self-healing elastomer 315 may include one or more materials that change its color. In some embodiments self-healing elastomer 315 may approximately match a color of housing 150. Other formulations may be used without departing from the invention.

As illustrated in FIG. 4, plurality of contacts 310 may be disposed on substrate 410 and connected by electrical traces 415 to electronic circuitry 134 (see FIG. 2). During normal operation self-healing elastomer 315 may provide an aesthetic cover over connector 140 and opening 305. That is, the user may not be able to discern connector 140 upon a casual inspection of electronic device 100. In some embodiments, self-healing elastomer 315 may provide a protective barrier for and/or a hermetic around opening 305 thus providing protection for connector 140, contacts 310 and housing 150 against debris, water, water vapor, and/or gasses. moisture and such that water and debris may not penetrate the self-healing elastomer.

To manufacture electronic device 100 with self-healing elastomer 315, the self-healing elastomer may be applied to housing 150 in liquid form and cured in place. In other embodiments, self-healing elastomer 315 may be insert-molded on housing 150. In further embodiments, self-healing elastomer 315 may be pre-molded and subsequently attached to housing 150 with an adhesive or by other means. In some embodiments, housing 150 includes one or more retention features formed in the sidewall of the housing around opening 150 that helps improve adhesion between the elastomer and sidewall thus better secure self-healing elastomer 315 to the housing as described below in conjunction with FIG. 11. Myriad methods may be used to form self-healing elastomer 315 and attach it to housing 150 without departing from the invention.

Figure 5:
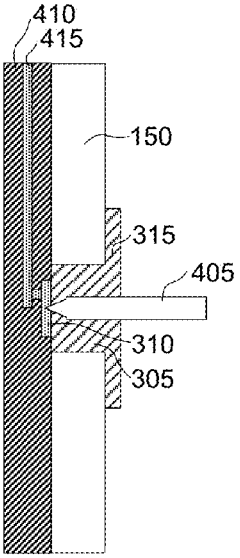
FIG. 5 is a cross-sectional view of the electrical connector shown in FIG. 3 during probe penetration.
Figure 6:
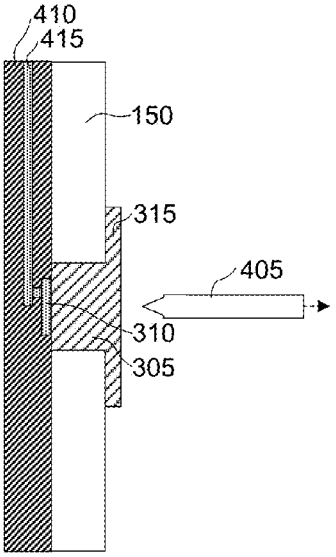
FIG. 6 is a cross-sectional view of the electrical connector shown in FIG. 3 after probe penetration.

Reference is now made to FIGS. 5 and 6, which illustrate simplified cross-sectional views of connector 140 and self-healing elastomer 315 during penetration by an electronic probe 405 and after removal of the electronic probe, respectively. In some embodiments, electronic probe 405 may be integrated within data plug connector 155 (see FIG. 2) while in other embodiments it may be a separate device. In further embodiments there may be as many electronic probes within data plug connector 155 (see FIG. 2) as there are contacts 310.

As illustrated in FIGS. 5 and 6, electronic probe 405 may be relatively thin and generally pointed with a sharp tip to penetrate self-healing elastomer 315 and make an electrical connection with contacts 310. In some embodiments, contacts 310 may be metallic and may be plated with one or more layers of metal including, but not limited to gold, silver, palladium or tin.

When electrical probe 405 is engaged with connector contact 310, electrical current may pass between electrical probe 405 and contact 310 through trace 415 to electrical circuitry 134 (see FIG. 2) disposed within housing 150. In some embodiments data and/or power may be transferred to and from electronic device 100 by one or more electrical probes 405 disposed within data plug 155 (see FIG. 2). More specifically, in some embodiments plurality of contacts 310 may comprise a power contact, a ground contact and a pair of data contacts. Other embodiments may have different configurations for contacts 310. For example, in one embodiment contacts 310 may not transfer data or power, but may simply be shorted together to perform a reset function or other operation on electronic device 100 (see FIG. 1). Contacts 310 may have myriad configurations and purposes without departing from the scope of the invention.

FIG. 6 illustrates self-healing elastomer 315 after electrical probe 405 has been removed. As illustrated, self-healing elastomer 315 heals in the penetration region after removal of electrical probe 405. As defined herein, heals shall mean that self-healing elastomer 315 may reseal itself and regain at least some of its aesthetic, mechanical and/or protective properties. That is, in some embodiments self-healing elastomer 315 may elastically resume its prior shape, resuming its aesthetic appearance prior to penetration. In further embodiments, self-healing elastomer 315 may also resume providing a water resistant barrier and/or debris protection for contacts 310 and housing 150.

Because of its self-healing nature, elastomer 315 may be penetrated multiple times by electrical probe 405 while retaining its protective properties. In some embodiments, self-healing elastomer may "heal" by reforming chemical bonds, regaining at least some of its mechanical properties in the penetration region. In yet further embodiments, self-healing elastomer 315 may reform covalent bonds in the penetration region and regain at least 30 percent of its tensile strength in the penetration region. In other embodiments, it may regain at least 50 percent of its tensile strength in the penetration region. In further embodiments it may regain at least 70 percent of its tensile strength in the penetration region. In yet further embodiments it may regain at least 90 percent of its tensile strength in the penetration region. In some embodiments the recovery of tensile strength may be temperature dependent. For example, in some embodiments recovery may occur between 44 and 92 degrees centigrade. In other embodiments the recovery of tensile strength may be temperature dependent and may improve with an increase in temperature. In some embodiments the recovery of tensile strength may occur between 52 and 84 degrees centigrade. In other embodiments the recovery of tensile strength may occur between 60 and 76 degrees centigrade. In further embodiments the recovery of tensile strength may occur at approximately 68 degrees centigrade. In some embodiments self-healing elastomer 315 may be applied to housing 150, and while in a partially cured condition it may be penetrated by electrical probe 405 and fully cured after removal of the electrical probe.

Figure 7:
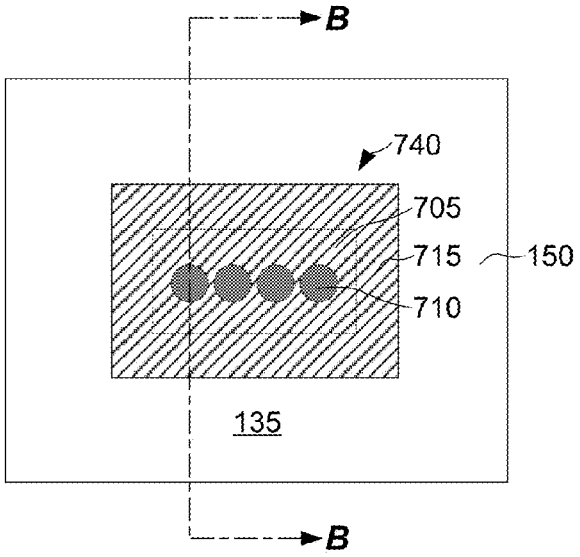
FIG. 7 is a plan view of an electrical connector covered by a self-healing elastomer with conductively doped regions according to an embodiment of the invention.
Figure 8:
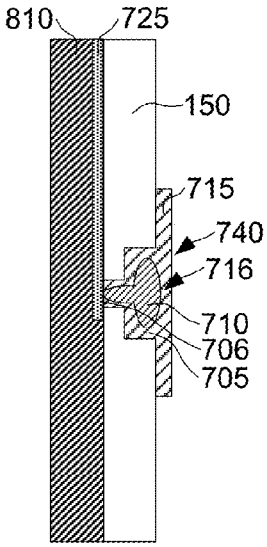
FIG. 8 is a cross-sectional view of the electrical connector shown in FIG. 7 before probe penetration.

FIG. 7 depicts a simplified close up plan view of another embodiment of the invention showing data connector 740 having a plurality of contacts 710 and a self-healing elastomer 715. Data connector 740 may be employed on electronic device 100 (see FIG. 1) or any other electronic device. Electronic device 100 is used for example only and is not intended to be limiting. In this embodiment, plurality of contacts 710 are conductively doped regions 716, which will be described in more detail below. FIG. 8 illustrates a simplified cross-section (see section B-B in FIG. 7) through one of plurality of contacts 710. Housing 150 has an opening 705. Data connector 740 is operatively coupled to electronic circuitry within housing 150. Data connector 740 includes a plurality of contacts 710 connected to substrate 810 and accessible through opening 705. Although plurality contacts 710 are illustrated as four circular conductively doped regions 716 arranged in a linear pattern, the plurality of contacts may be of any number, any shape and any pattern. Substrate 810 may be a part of electronic circuitry 134 (see FIG. 2) disposed within housing 150.

A layer of self-healing elastomer 715 covers opening 705 and plurality of contacts 710. In some embodiments self-healing elastomer 715 extends over housing 150, beyond opening 705. In other embodiments self-healing elastomer 715 may be disposed only within opening 705 and may not extend over housing 150. The size and thickness of self-healing elastomer 715 may depend on the size of opening 705, which in turn is dependent on the size and shape of connector 740 and the thickness of housing 150. Self-healing elastomer 715 may entirely cover opening 705 such that plurality of contacts 710 cannot be seen. In further embodiments, self-healing elastomer 715 may be filled with a pigment and blended with housing 150 such that it may appear contiguous with the housing and substantially imperceptible. In some embodiments where the thickness of the electronic device is critical, self-healing elastomer 715 may be less than 0.5 mm thick. In other embodiments self-healing elastomer 715 may be between 0.5 mm to 0.1 mm thick. In further embodiments self-healing elastomer 715 may be between 0.1 mm to 0.2 mm thick. In yet further embodiments self-healing elastomer 715 may be greater than 0.2 mm thick. In other embodiments the thickness of self-healing elastomer 715 may be greater than 0.5 mm.

As discussed above, self-healing elastomer 715 may be a polymer with elastic properties such as a low Young's modulus and a high failure strain. In further embodiments self-healing elastomer 715 may include one or more materials that change its color. In some embodiments self-healing elastomer 715 may approximately match a color of housing 150. Other formulations may be used without departing from the invention.

To manufacture electronic device 100 (see FIG. 1) with self-healing elastomer 715, the self-healing elastomer may be applied to housing 150 in liquid form and cured in place. In other embodiments, self-healing elastomer 715 may be insert-molded on housing 150. In further embodiments, self-healing elastomer 715 may be pre-molded and subsequently attached to housing 150 with an adhesive or by other means. To form plurality of contacts 710 using conductively doped regions 716, conductive particulates such as, but not limited to, silver, gold, palladium, copper or metal coated spheres may be introduced into self-healing elastomer 715.

More specifically, in one embodiment, electrically conductive particulates may be dispersed in self-healing elastomer 715 by a dispenser or other method before it is cured. In another embodiment a mixture of an elastomer and conductive particulates may be dispersed in self-healing elastomer 715 by a dispenser or other method before it is cured. In other embodiments, conductively doped regions 716 may be formed by first casting or molding the conductively doped regions, then forming self-healing elastomer 715 around the conductively doped regions. In yet further embodiments, self-healing elastomer 715 and conductively doped regions 716 may be manufactured from multiple sequentially deposited layers in a laminate format. That is, in one embodiment each layer may be 0.1 mm thick and thus a 0.5 mm thick self-healing elastomer 715 may be made from approximately five layers. The layers may employ the self-healing nature of elastomer 715 to bond together. Myriad methods may be used to form self-healing elastomer 715 and attach it to housing 150 without departing from the invention. Conductively doped regions 716 may be in electrical contact with an exposed region 706 of trace 725. Conductively doped regions 716 may not be visible from the outside of electronic device 100 (see FIG. 1).

Figure 9:
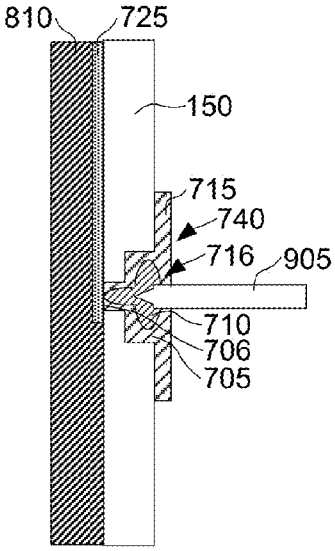
FIG. 9 is a cross-sectional view of the electrical connector shown in FIG. 7 during probe penetration.
Figure 10:
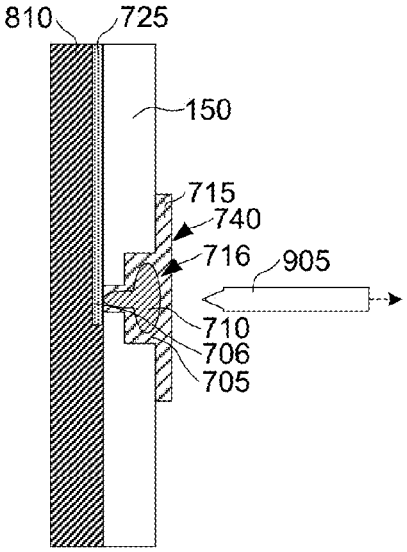
FIG. 10 is a cross-sectional view of the electrical connector shown in FIG. 7 after probe penetration.

FIG. 8 illustrates a cross-sectional view self-healing elastomer 715 on device 100 (see FIG. 1) while in a normal operating state, and FIGS. 9 and 10 illustrate cross-sectional views of the self-healing elastomer during penetration by electronic probe 905 and after removal of the electronic probe, respectively. In some embodiments, electronic probe 905 may be integrated within data plug connector 155 (see FIG. 2) while in other embodiments it may be a separate device. In further embodiments there may be as many electronic probes within data plug connector 155 (see FIG. 2) as there are contacts 710.

As illustrated in FIG. 8, plurality of contacts 710 may be connected to substrate 810 and coupled by electrical traces 725 to electronic circuitry 134 (see FIG. 2). During normal operation self-healing elastomer 715 may provide an aesthetic cover over connector 740 including plurality of contacts 710 and opening 705. That is, one may not be able to discern connector 740 upon a casual inspection of electronic device 100 (see FIG. 1).

In other embodiments, self-healing elastomer 715 may provide moisture and debris protection for connector 740, contacts 710 and housing 150 such that water and debris may not penetrate the self-healing elastomer. In further embodiments, self-healing elastomer 715 may provide a barrier against water vapor and in yet further embodiments may provide a hermetic seal (i.e., impervious to gasses). Self-healing elastomer 715 may be sufficiently bonded to housing 150 such that the self-healing elastomer also provides a protective barrier for opening 705 against debris, water, water vapor, and/or gasses.

As illustrated in FIGS. 9 and 10 electronic probe 905 may be generally pointed with a sharp tip to penetrate self-healing elastomer 715 and make an electrical connection with contacts 710. In this embodiment, contacts 710 may consist of one or more conductively doped regions 716 within self-healing elastomer 715 and may be disposed over one or more of each of exposed regions 706 of traces 725. In some embodiments, exposed regions 706 may be metallic and may be plated with one or more layers of metal including, but not limited to gold, silver, palladium or tin.

When electrical probe 905 is engaged with contact 710, electrical current may pass through electrical probe 905, through conductively doped region 716 to exposed region 706 and through trace 725 to electrical circuitry 134 (see FIG. 2) disposed within housing 150. Electrical conduction within conductively doped regions 716 may occur by conduction from one conductive particle to another conductive particle. In some embodiments data and/or power may be transferred to and from electronic device 100 by one or more electrical probes 905 disposed within data plug 155 (see FIG. 2). More specifically, in some embodiments plurality of contacts 710 may comprise a power contact, a ground contact and a pair of data contacts. Other embodiments may have different configurations for contacts 710. For example, in one embodiment contacts 710 may not transfer data or power, but may simply be shorted together to perform a reset function or other operation on electronic device 100 (see FIG. 1). Contacts 710 may have myriad configurations and purposes without departing from the scope of the invention.

FIG. 10 illustrates self-healing elastomer 715 after electrical probe 905 has been removed. As discussed above, self-healing elastomer 715 heals in the penetration region after removal of electrical probe 905. Further, in some embodiments, conductively doped regions 716 may also include a self-healing elastomer that heals after removal of probe 905. The healing may restore all or some of the aesthetic, protective and/or mechanical properties of self-healing elastomer 715 and conductively doped regions 714.

In another embodiment, self-healing elastomer 715 may contain one or more conductively doped regions 716 for the purposes of improving and/or enhancing electrical contact between electrical probe 905 and exposed region 706 of trace 725. More specifically, in such embodiments, electrical probe 905 may partially or nearly contact exposed region 706 and conductively doped region 716 may make the electrical connection more reliable and consistent by compressing conductive particulates against the electrical probe and the exposed region.

Figure 11:
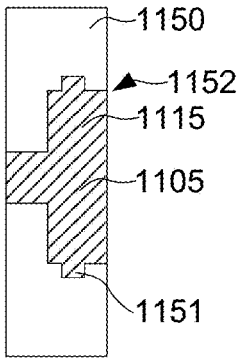
FIG. 11 is a cross-sectional view of an opening in a housing filled with a self-healing elastomer according to an embodiment of the invention.

FIG. 11 illustrates another embodiment of a housing 1150 that may be employed on an electronic device such as device 100 (see FIG. 1). This embodiment includes one or more retention features 1151 that are formed in one or more sidewalls of opening 1105 that may provide access to an electronic connector such as connector 140 (see FIG. 1). Similar to the previous embodiments, opening 1105 is filled with self-healing elastomer 1115 such that one or more probes may temporarily penetrate it to access one or more contacts (not shown) of the electrical connector. Self-healing elastomer 1115 may or may not contain conductively doped regions, as discussed above. In addition, in this particular embodiment, edges 1152 of self-healing elastomer 1115 are flush with housing 1150.

Retention features 1151 formed in sidewalls of opening 1105 may improve the adhesion of self-healing elastomer 1115 to housing 1150. In some embodiments, retention features 1151 may be formed by an injection molding process while in other embodiments the features may be formed by a post-processing operation on housing 1150 such as machining, melting or grinding. In further embodiments, other manufacturing methods may be used to form retention features 1151. Improved adhesion of self-healing elastomer 1115 may result in more reliable retention of the self-healing elastomer in housing 1150. Additionally, retention features 1151 may result in an improved barrier against water, water vapor, debris and/or gas penetration by creating an improved mechanical lock between self-healing elastomer 1115 and housing 1150 such that delamination does not occur. In further embodiments retention features 1151 may be different than those illustrated and may be a roughened surface or other type of mechanical locking feature. In other embodiments, a primer or surface treatment may be used on housing 1150 prior to application of self-healing elastomer 1115 to improve the adhesion of the self-healing elastomer to the housing.

Edges 1152 of self-healing elastomer 1115 that are flush with housing 1150 may improve the blending of the self-healing elastomer with the housing. The improved blending may result in improved aesthetics, making self-healing elastomer 1115 more difficult to discern from housing 1150. This feature may be beneficial when it is desirable to obscure the connector from the user. For example, an electronic device may be so small that it may be undesirable to have an external connector consume a significant portion of the outside surface, marring the aesthetics of the device. In addition, it may be desirable to deliver an electronic device that is completely wireless, however an external connector may be required for manufacturing and/or diagnostics so methods to obscure the connector from view may at least provide the appearance of a completely wireless device. Further, flush edges 1152 may reduce the likelihood of self-healing elastomer 1115 from being torn or disassociated from housing 1150. Other edge 1152 designs may be employed on self-healing elastomer 1115 such as tapered edges, illustrated in FIG. 12. Flush edge 1152 may be formed during formation of self-healing elastomer 1115, or after formation with a material removal process such as cutting, lasering, melting, grinding or the like.

Figure 12:
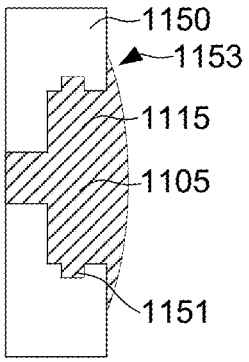
FIG. 12 is a cross-sectional view of an opening in a housing filled with a self-healing elastomer according to an embodiment of the invention.

FIG. 12 illustrates another embodiment of a housing 1150 that may be employed on an electronic device such as device 100 (see FIG. 1), similar to the embodiment described in FIG. 11. This embodiment also includes one or more retention features 1151 formed in opening 1105 that is filled with self-healing elastomer 1115. However, this embodiment has tapered edges 1153 on self-healing elastomer 1115.

Tapered edges 1153 of self-healing elastomer 1115 may improve the blending of the self-healing elastomer with housing 1150. The improved blending may result in improved aesthetics, making self-healing elastomer 1115 more difficult to discern from housing 1150. As discussed above, this feature may be beneficial when it is desirable to obscure the connector from the user and/or reduce the likelihood of self-healing elastomer 1115 from being torn or disassociated from housing 1150. Other edge 1153 designs may be employed on self-healing elastomer 1115 such as, for example, a radius, a chamfer or a sub-flush edge. A sub-flush edge is where self-healing elastomer 1115 is disposed below an outer surface of housing 1150.

Figure 13A:
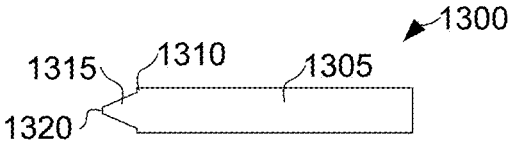
FIG. 13A is a side view of an electrical probe according to an embodiment of the invention.
Figure 13B:
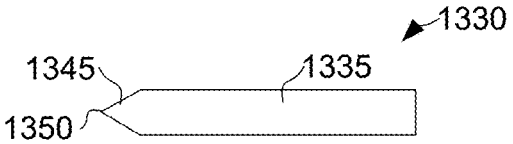
FIG. 13B is a side view of an electrical probe according to an embodiment of the invention.
Figure 13C:
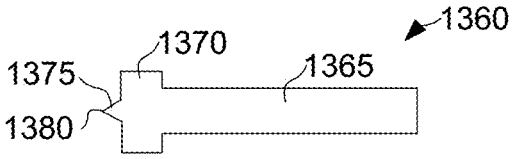
FIG. 13C is a side view of an electrical probe according to an embodiment of the invention.

FIGS. 13A through 13C illustrate various embodiments of electrical probes that may be used to temporarily penetrate the self-healing elastomer to connect with the connector contacts. In some embodiments the electrical probes may be designed to minimize damage to the self-healing elastomer, and/or to make electrical contact with the connector contacts. In further embodiments the probes may be made from an electrically conductive material such as, but not limited to, brass, copper, bronze, steel or nickel. In other embodiments, the electrical probes may have one or more layers of plating such as, but not limited to, nickel, gold, silver, tin or palladium. The plating may be used to decrease contact resistance between the probe and the contact and/or to improve the durability of the probe. Myriad probe designs may be used without departing from the invention. In further embodiments, the electrical probes may not be oriented perpendicular to the contacts (as illustrated in FIGS. 4-6) during penetration and may approach the contacts at an obtuse angel. In other embodiments, the electrical probes may be guided to the electrical contacts by the opening in the housing or another alignment feature on the electronic device. In further embodiments, external fixturing may align the electrical probes with the contacts.

FIG. 13A illustrates electrical probe 1300 having a shaft 1305 with a shoulder 1310 and a tapered nose portion 1315 terminating in a blunt tip 1320. Blunt tip 1320 may increase the physical contact area with contact 310 (see FIG. 3) and may minimize penetration of probe 1300 into the contact.

FIG. 13B illustrates an electrical probe 1330 having a shaft 1335 with a tapered nose portion 1345 terminating in a sharp tip 1350. Sharp tip 1350 may decrease the damage to self-healing elastomer and may allow probe 1330 to penetrate contact 310 (see FIG. 3) making a more reliable electrical connection.

FIG. 13C illustrates an electrical probe 1360 having a shaft 1365 with an enlarged shoulder 1370, a short tapered nose portion 1375 terminating in a sharp tip 1380. Sharp tip 1380 may allow probe 1360 to penetrate contact 310 (see FIG. 3) making a more reliable electrical connection, and enlarged shoulder 1370 may limit the penetration depth of probe 1360 into contact 310 (see FIG. 3).

Figure 14:
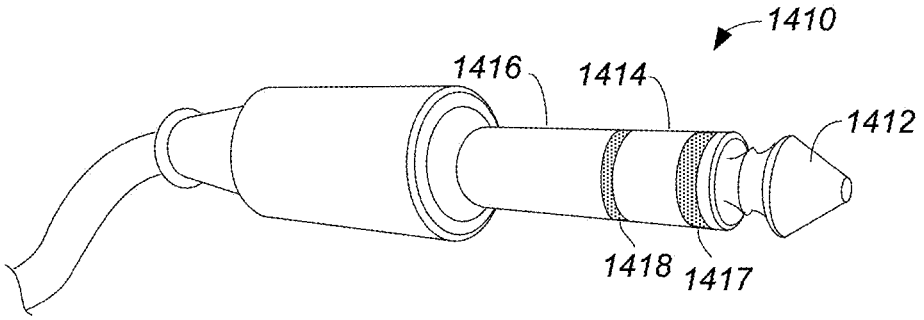
FIG. 14 is a perspective view of an audio plug connector according to an embodiment of the invention.
Figure 15:
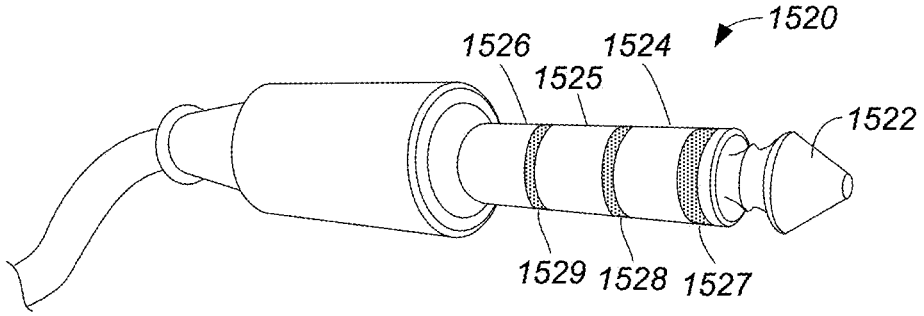
FIG. 15 is a perspective view of an audio plug connector according to an embodiment of the invention.

Embodiments of the present invention may include a connector disposed in an electronic device for receiving an audio plug such as plug 145 in FIG. 2. Standard audio plugs, such as those illustrated in FIGS. 14 and 15, are available in three sizes according to the outside diameter of the plug: a 6.35 mm (¼") plug, a 3.5 mm (⅛") miniature plug and a 2.5 mm (3/32") subminiature plug. Plugs 1410 and 1520 include multiple conductive regions that extend along the length of the connectors in distinct portions of the plug such as the tip, sleeve and one or more middle portions or "rings" located between the tip and sleeve, resulting in the connectors often being referred to as TRS (tip, ring and sleeve) connectors.

More specifically, FIGS. 14 and 15 illustrate examples of audio plugs 1410 and 1520 having three and four conductive portions, respectively. As shown in FIG. 14, plug 1410 includes a conductive tip 1412, a conductive sleeve 1416 and a conductive ring 1414 electrically isolated from tip 1412 and sleeve 1416 by insulating rings 1417 and 1418. The three conductive portions 1412, 1414, 1416 are for left and right audio channels and a ground connection, respectively.

Plug 1520, shown in FIG. 15, includes four conductive portions: a conductive tip 1522, a conductive sleeve 1526 and two conductive rings 1524, 1525 and is thus sometime referred to as a TRRS (tip, ring, ring, sleeve) connector. The four conductive portions 1522, 1524, 1525 and 1526 are electrically isolated by insulating rings 1527, 1528 and 1529 and are typically used for left and right audio, ground and microphone signals, respectively.

When plugs 1410 and 1520 are 3.5 mm miniature connectors, the outer diameter of conductive sleeve 1416, 1526 and conductive rings 1414, 1524, 1525 is 3.5 mm and the insertion length of the connector is 14 mm. For 2.5 mm subminiature connectors, the outer diameter of the conductive sleeves is 2.5 mm and the insertion length of the connector is 11 mm long. Such TRS and TRRS connectors are used in many commercially available MP3 players and smart phones as well as other electronic devices.

Figure 16:
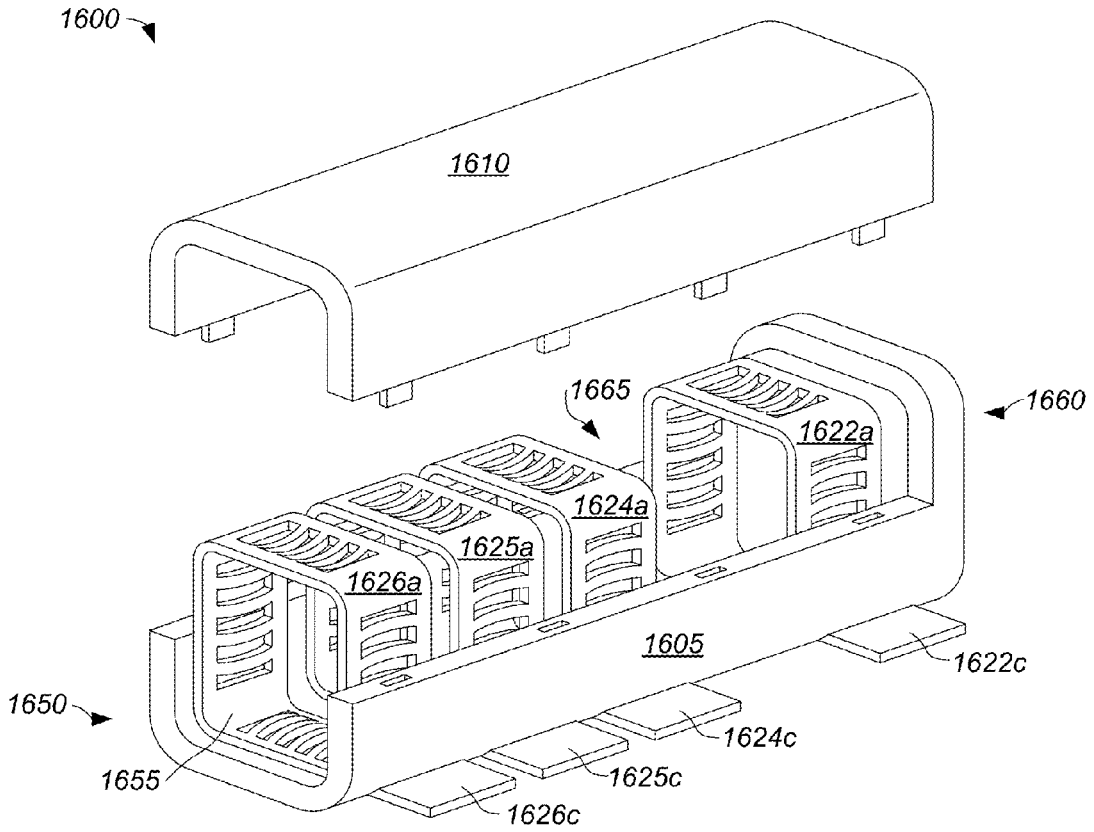
FIG. 16 is an exploded perspective view of an audio receptacle connector according to an embodiment of the invention.

Plugs 1410 and 1520 may interface with a connector, such as connector 1600 in FIG. 16, mounted in an electronic device such as device 100 in FIG. 2. Because connector 1600 is accessible from the exterior of electronic device 100, it may be exposed to moisture or debris that pose little or no risk to the consumer, but present a harsh environment for the connector contacts and electronic circuitry within the electronic device. For example, electronic devices and their connectors regularly come into contact with water, sweat, and other elements that may corrode or contaminate the contacts and may penetrate the electronic device, harming circuitry within its housing. Embodiments of the invention may include the use of a self-healing elastomer on such audio connectors to provide improved reliability and/or improved resistance to liquid, moisture and/or gas ingression. However, these embodiments should in no way limit the applicability of the invention to other connectors.

FIG. 16 is a simplified exploded perspective view of audio connector 1600, in accordance with one embodiment of the invention. Connector 1600 may include a body having an opening 1655 that communicates with a cavity 1665 having height, width and depth dimensions. Connector 1600 may have a receiving face 1650 with front opening 1655 to receive a plug portion of a mating audio plug connector 145 (e.g., FIGS. 14 and 15) and rear face 1660 disposed opposite of the receiving face. Housing 1605, 1610 may extend between receiving face 1650 and rear face 1660 and define a cavity 1665 that communicates with front opening 1655. A plurality of sequentially arranged contacts 1622*a*, 1624*a*, 1625*a*, 1626*a*, may be sequentially positioned within and spaced apart along a depth of the cavity and each may have external portions 1622*c*, 1624*c*, 1625*c*, 1626*c* disposed outside of housing 1605, 1610. External portions 1622*c*, 1624*c*, 1625*c*, 1626*c* may be configured to mount connector 1600 to a printed circuit board or similar structure and provide an electrical path from contacts 1622*a*, 1624*a*, 1625*a*, 1626*a* to circuitry within the electronic device. Other types and configurations of audio connectors may be used without departing from the invention.

Figure 17:
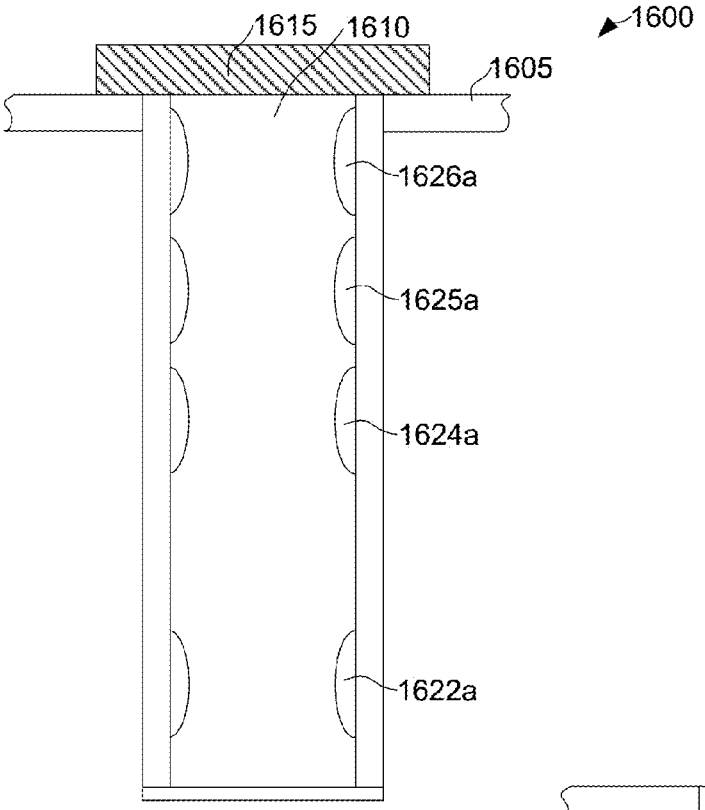
FIG. 17 is a cross-sectional view of an audio connector installed in a housing having a self-healing elastomer barrier layer according to an embodiment of the invention.

FIG. 17 illustrates a cross-sectional view of audio connector 1600 (see FIG. 16) installed within housing 1605 of an electronic device such as device 100 in FIG. 2. Contacts 1622*a*, 1624*a*, 1625*a*, 1626*a* are accessible through opening 1610 in housing 1605. A layer of self-healing elastomer 1615 is disposed over opening 1610 in housing 1605. Self-healing elastomer 1615 may provide a protective barrier for contacts 1622*a*, 1624*a*, 1625*a*, 1626*a* and housing 1605. More specifically, in some embodiments, self-healing elastomer 1615 may provide moisture and debris protection to contacts 1622*a*, 1624*a*, 1625*a*, 1626*a* and housing 1605 such that water and debris may not penetrate the self-healing elastomer. In further embodiments, self-healing elastomer 1615 may provide a barrier against water vapor and in further embodiments may provide a hermetic seal (i.e., impervious to gasses). Self-healing elastomer may be bonded to housing 1605 and may have flush or tapered edges as discussed above. In other embodiments, self-healing elastomer 1615 may be filled with one or more pigments to obscure contacts 1622*a*, 1624*a*, 1625*a*, 1626*a* and opening 1610 as also discussed above.

Audio connectors such as those illustrated in FIGS. 14 and 15 may penetrate self-healing elastomer 1615 to make electrical contact with contacts 1622*a*, 1624*a*, 1625*a* and 1626*a*. Once the audio connector is removed, self-healing elastomer 1615 may self-heal, regaining at least some of its aesthetic, protective and/or mechanical properties.

Figure 18:
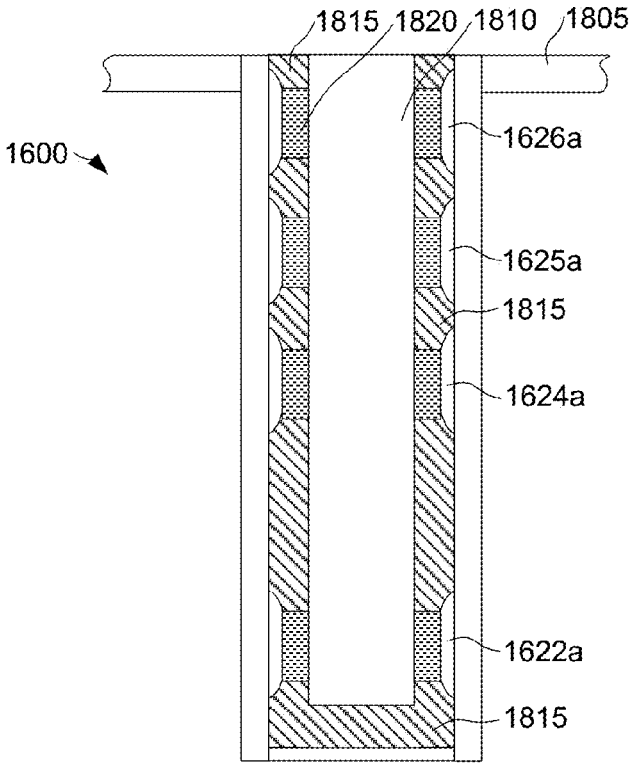
FIG. 18 is a cross-sectional view of an audio connector installed in a housing having a self-healing elastomer barrier layer with conductively doped regions over the connector contacts according to an embodiment of the invention.

FIG. 18 illustrates another embodiment showing a cross-sectional view of audio connector 1600 (see FIG. 16) installed within housing 1805 of an electronic device such as device 100 in FIG. 2. In this embodiment, a self-healing elastomer 1815 with conductively doped regions 1820 is disposed inside of audio connector 1600. Contacts 1622*a*, 1624*a*, 1625*a*, 1626*a* are accessible through opening 1810 in housing 1805. A layer of self-healing elastomer 1815 is disposed in a cylindrical shape over the interior of audio connector 1600. Self-healing elastomer 1815 may provide a protective barrier for contacts 1622*a*, 1624*a*, 1625*a*, 1626*a* and housing 1805. More specifically, in some embodiments, self-healing elastomer 1815 may provide moisture and debris protection to contacts 1622*a*, 1624*a*, 1625*a*, 1626*a* and housing 1805 such that water and debris may not penetrate the self-healing elastomer. In further embodiments, self-healing elastomer 1815 may provide a barrier against water vapor and in further embodiments may provide a hermetic seal (i.e., impervious to gasses). Self-healing elastomer may be bonded to housing 1805 and may have flush or tapered edges as discussed above. In other embodiments, self-healing elastomer 1815 may be filled with one or more pigments to obscure contacts 1622*a*, 1624*a*, 1625*a*, 1626*a* and opening 1810 as also discussed above.

As further illustrated, one or more conductively doped regions 1820 may be disposed over each of contacts 1622*a*, 1624*a*, 1625*a*, 1626*a*. Thus, when conductive sleeves 1416, 1526 and conductive rings 1414, 1524, 1525 of audio connectors 1410 and 1520 (see FIGS. 14 and 15) come into contact with conductively doped regions 1820, electrical contact is made between the audio connectors and the circuitry within housing 1805. In some embodiments an additional layer of self-healing elastomer may be placed over opening 1810.

In some embodiments self-healing elastomer 1820 may be manufactured as discussed above, and subsequently inserted into cavity 1665 (see FIG. 16) of connector 1600. In other embodiments, self-healing elastomer may be molded around contacts 1622*a*, 1624*a*, 1625*a*, 1626*a* and installed as an assembly into housing 1605, 1610 (see FIG. 16). Other methods may be used to manufacture the embodiment illustrated in FIG. 18 without departing from the invention.

Figure 19:
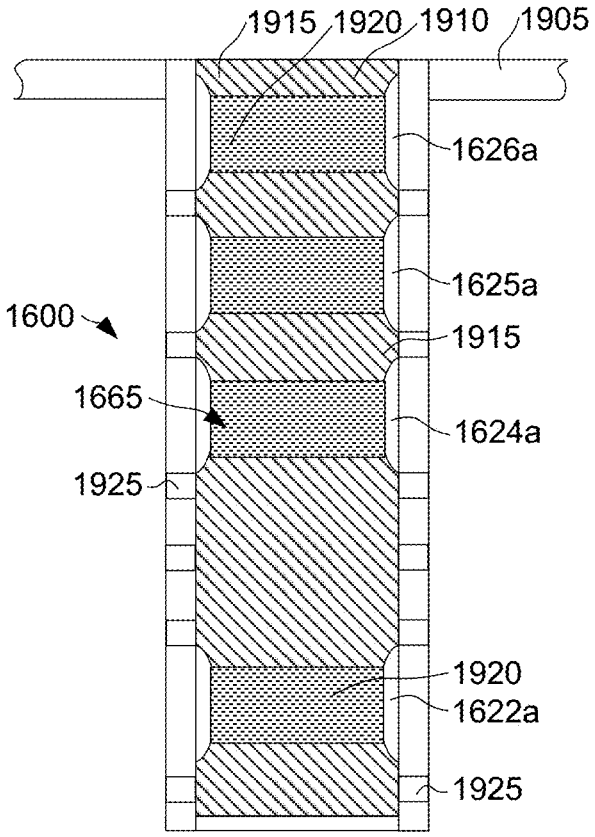
FIG. 19 is a cross-sectional view of an audio connector installed in a housing having a self-healing elastomer barrier layer with conductively doped regions over the connector contacts according to an embodiment of the invention.

FIG. 19 illustrates another embodiment showing a cross-sectional view of audio connector 1600 (see FIG. 16) installed within housing 1905 of an electronic device such as device 100 in FIG. 2. Similar to the embodiment described in FIG. 18, a self-healing elastomer 1915 having conductively doped regions 1920 is disposed inside of audio connector 1600. However, in this embodiment substantially the entire cavity 1665 (see FIG. 16) of connector 1600 is filled with self-healing elastomer 1915. Contacts 1622*a*, 1624*a*, 1625*a*, 1626*a* are accessible through opening 1910 in housing 1905. Layers of self-healing elastomer 1915 are disposed in a cylindrical shape in the interior of audio connector 1600. Layers of conductively doped regions 1920 are also disposed in cylindrical shapes in the interior of audio connector 1600. Layers of self-healing elastomer 1915 are disposed between layers of conductively doped regions 1920 to provide electrical isolation.

As further illustrated, one or more conductively doped regions 1920 may be disposed over each of contacts 1622*a*, 1624*a*, 1625*a*, 1626*a*. Thus, when conductive sleeves 1416, 1526 and conductive rings 1414, 1524, 1525 of audio connectors 1410 and 1520 (see FIGS. 14 and 15) come into contact with conductively doped regions 1920, electrical contact is made between the audio connectors and the circuitry within housing 1905. In some embodiments an additional layer of self-healing elastomer may be placed over opening 1910.

Displacement ports 1925 may be disposed within the audio connector housing to provide for displacement of self-healing elastomer 1910 and conductively doped regions 1920 when an audio connector plug (e.g., FIGS. 14 and 15) is inserted in audio connector 1600. Upon removal of audio connector plug, self-healing elastomer 1910 and conductively doped regions 1920 may regain at least some of their aesthetic, protective and/or mechanical properties.

As discussed above, self-healing elastomer 1910 may provide a protective barrier for contacts 1622*a*, 1624*a*, 1625*a*, 1626*a* and housing 1905. Self-healing elastomer 1910 may be bonded to housing 1905 and may have flush or tapered edges as discussed above. In other embodiments, self-healing elastomer 1910 may be filled with one or more pigments to obscure contacts 1622*a*, 1624*a*, 1625*a*, 1626*a* and opening 1910 as also discussed above.

In some embodiments self-healing elastomer 1920 may be manufactured as discussed above, and subsequently inserted into cavity 1665 (see FIG. 16) of connector 1600. In other embodiments, self-healing elastomer 1920 may be molded around contacts 1622*a*, 1624*a*, 1625*a*, 1626*a* and installed as an assembly into housing 1605, 1610 (see FIG. 16). In further embodiments, layers of self-healing elastomer 1920 may be deposited within cavity 1556 and alternated with layers of conductively doped regions 1920. Other methods may be used to manufacture the embodiment illustrated in FIG. 19 without departing from the invention.

Figure 20:
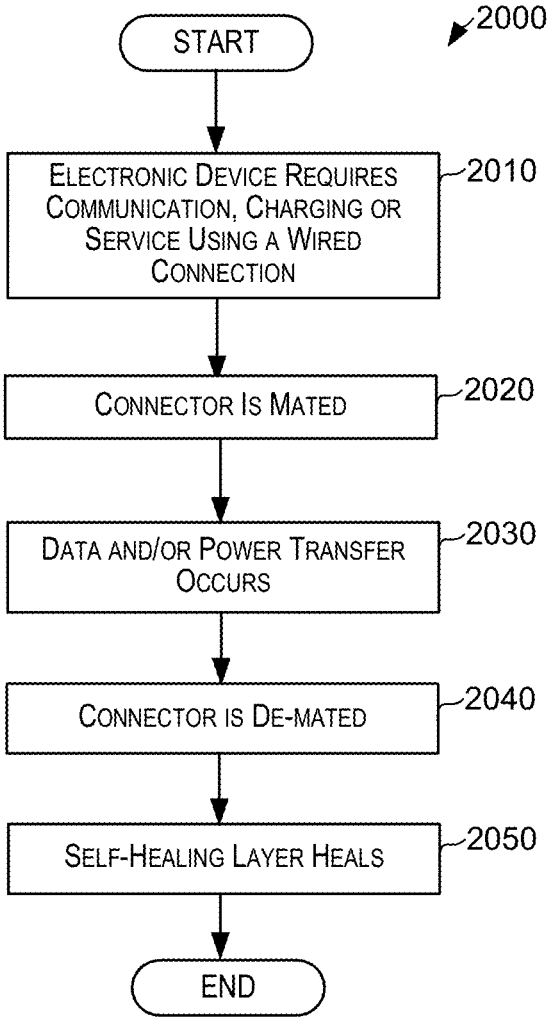
FIG. 20 is a method for mating a data or audio connector with an external connector on an electronic device having a self-healing layer.

FIG. 20 depicts a simplified flowchart 2000 illustrating a general method for interfacing with an electronic device equipped with a hidden connector. The particular series of processing steps depicted in FIG. 20 is not intended to be limiting.

As depicted in FIG. 20, the method may be initiated at 2010 when an electronic device equipped with one or more external connectors requires communication, charging or service using a wired connection. The external connector may have a self-healing elastomer disposed over the connector to improve the device aesthetics and/or to protect the connector and the device from damage.

In some embodiments, such an electronic device may require programming at the manufacturing facility and a wired communication system may be the most tractable method. In other embodiments, such an electronic device may require a wired connection for charging or servicing. More specifically, in some embodiments, an electronic device may be completely wireless (e.g., equipped with wireless communication and charging capabilities) except for a single connector covered by a self-healing elastomer. Thus, in some scenarios the most tractable method to service the device may be through a wired connection, such as, for example, when the internal battery is drained and the wireless communication system is unavailable. In other embodiments an audio system may require a wired connection to the electronic device.

At 2020, a data or audio connector may be mated with the external connector on the electronic device. The data or audio connector may have one or more probes, each having a relatively pointed tip to effectively penetrate the self-healing elastomer to make contact with the external connector's electrical contacts. In some embodiments the external connector contacts are metallic pads on a substrate while in other embodiments the external connector contacts may be conductively doped regions within the self-healing elastomer. The data or audio plug may be aligned with the external connector using alignment features in the electronic device and/or external fixtures. The probes within the data or audio connector may pierce the self-healing elastomer in a penetration region, temporarily displacing the self-healing elastomer to make an electrical connection with the external connector contacts.

At 2030, the data or audio connectors are mated with the external connector on the electronic device and the power and/or data transfer occurs. Current may flow through the electronic probes, through the external connector contacts and to the circuitry within the electronic device.

At 2040, the data or audio connectors may be de-mated from the external connector of the electronic device. More specifically, the probes may be removed from the self-healing elastomer and the elastomer may elastically resume its shape prior to the penetration.

At 2050, the self-healing elastomer heals in the penetration region. More specifically, self-healing elastomer may reseal itself and regain at least some of its aesthetic, mechanical and/or protective properties. That is, in some embodiments the self-healing elastomer may resume providing an aesthetic covering, a water resistant barrier and/or debris protection for the external connector and the electronic device.

In further embodiments, the self-healing elastomer may "heal" by reforming chemical bonds, regaining at least some of its mechanical properties in the penetration region. In yet further embodiments, the self-healing elastomer may reform covalent bonds in the penetration region and regain at least 30 percent of its tensile strength in the penetration region. In other embodiments, it may regain at least 50 percent of its tensile strength in the penetration region. In further embodiments it may regain at least 70 percent of its tensile strength in the penetration region. In yet further embodiments it may regain at least 90 percent of its tensile strength in the penetration region. In some embodiments the recovery of tensile strength may occur at approximately 68 degrees centigrade. In other embodiments the recovery of tensile strength may be temperature dependent and may improve with an increase in temperature. In some embodiments the recovery of tensile strength may occur between 60 and 76 degrees centigrade. In other embodiments the recovery of tensile strength may occur between 52 and 84 degrees centigrade. In further embodiments the recovery of tensile strength may occur between 44 and 92 degrees centigrade. In some embodiments the self-healing elastomer may only be penetrated once by the electrical probes, while in further embodiments it may be penetrated numerous times, self-healing after each penetration. In some embodiments the self-healing elastomer may be applied to the device housing, and while in a partially cured condition it may be penetrated by the electrical probes and fully cured after removal of the electrical probes.

In the foregoing specification, embodiments of the invention have been described with reference to numerous specific details that may vary from implementation to implementation. The specification and drawings are, accordingly, to be regarded in an illustrative rather than a restrictive sense. The sole and exclusive indicator of the scope of the invention, and what is intended by the applicants to be the scope of the invention, is the literal and equivalent scope of the set of claims that issue from this application, in the specific form in which such claims issue, including any subsequent correction.

What is claimed is:

1. An electronic device comprising:

a housing having an opening extending between an exterior surface and an interior surface of the housing;

a planar contact pad aligned with and accessible through the opening; and a layer of self-healing elastomer disposed within the opening and covering the planar contact pad such that a pin of a mating connector can be pushed in a direction perpendicular to the planar contact pad through the layer of self-healing elastomer to establish electrical contact with the planar contact pad.

2. The electronic device of claim 1 wherein the mating connector can be disconnected from the electronic device by translating the pin of the mating connector away from the planar contact pad.

3. The electronic device of claim 1 wherein the planar contact pad is disposed on a substrate that is located within the housing of the electronic device.

4. The electronic device of claim 1 wherein the self-healing elastomer has a color that substantially matches a color of the exterior housing and is aligned with the exterior surface to appear contiguous with the housing.

5. The electronic device of claim 1 wherein the self-healing elastomer forms a barrier to water entering the electronic device through the opening.

6. The electronic device of claim 1 wherein the self-healing elastomer fills the opening and includes an outer portion that extends over a portion of the housing surrounding the opening.

7. The electronic device of claim 1 wherein the electronic device comprises a plurality of planar contact pads aligned with and accessible through the opening and the layer of self-healing elastomer material covers each of the plurality of contact pads.

8. The electronic device of claim 1 wherein the planar contact pad is substantially parallel with the housing.

9. An electronic receptacle connector comprising: a housing having an opening extending between an exterior surface and an interior surface of the housing, the opening configured to receive a probe of a mating plug connector;

a planar contact pad aligned with and accessible through the opening and secured to a planar substrate positioned adjacent the interior surface of the housing; and a layer of self-healing elastomer disposed within the opening and covering the planar contact pad such that when the plug connector is mated with the receptacle connector the probe of the plug connector penetrates the layer of self-healing elastomer in a direction perpendicular to the planar contact pad to establish electrical contact with the contact pad.

10. The electronic receptacle connector of claim 9 wherein the electronic receptacle connector is integrated with an electronic device such that the housing is an exterior housing of the electronic device.

11. The electronic receptacle connector of claim 10 wherein the substrate couples electronic signals from the planar contact pad to circuitry within the electronic device.

12. The electronic receptacle connector of claim 10 wherein the electronic device is a wearable device.

13. The electronic receptacle connector of claim 9 wherein when the plug connector is disconnected from the receptacle connector the probe of the plug connector withdraws out of a penetration region of the self-healing elastomer and the self-healing elastomer regains at least 50 percent of its tensile strength in the penetration region.

14. The electronic receptacle connector of claim 9 wherein the planar contact pad is a metallic pad disposed on a substrate that is a printed circuit board.

15. An electronic device comprising;

an exterior housing having a cavity defined by a bottom surface and one or more sidewalls that extend from the bottom surface to a top surface of the exterior housing;

a planar contact pad disposed on the bottom surface; and a layer of self-healing elastomer disposed over the planar contact pad such that a plurality of pins pin of a mating connector can be pushed in a direction perpendicular to the planar contact pad through the layer of self-healing elastomer to establish electrical contact with the planar contact pad.

16. The electronic device of claim 15 wherein the one or more sidewalls of the cavity have a retention feature to anchor the self-healing elastomer to the exterior housing.

17. The electronic device of claim 15 wherein the self-healing elastomer comprises silicone.

18. The electronic device of claim 15 wherein there are a plurality of planar contact pads comprising a power contact pad, a ground contact pad and a pair of data contact pads.

19. The electronic device of claim 15 wherein the electronic device is a portable media player.

20. The electronic device of claim 15 wherein the electronic device is a wearable device.

* * * * *